US005273503A

United States Patent [19]

Hershey

[11] Patent Number: 5,273,503

[45] Date of Patent: Dec. 28, 1993

[54] AEROBIC EXERCISE CHAIR

[76] Inventor: Jacob R. Hershey, 1612 Lancaster Pike, Quarreyville, Pa. 17566

[21] Appl. No.: 67,377

[22] Filed: May 25, 1993

[51] Int. Cl.[5] ..... A63B 21/063

[52] U.S. Cl. ..... 482/96; 482/51

[58] Field of Search ..... 482/51-53, 482/70, 95-96, 121-138; 280/1.191, 87.01, 226.1, 230, 233, 253, 304.1

[56] References Cited

U.S. PATENT DOCUMENTS

| | | | |
|---|---|---|---|
| 248,121 | 10/1881 | Tuttle | 482/96 |
| 813,741 | 2/1906 | Budbeck | 280/233 X |
| 1,899,255 | 2/1933 | Bell | 482/96 |
| 2,252,156 | 8/1941 | Bell | 482/96 X |
| 2,455,548 | 12/1948 | Bell | 482/96 |
| 2,456,412 | 12/1948 | Heimbaugh | 482/96 |
| 2,470,544 | 5/1949 | Bell | 482/96 |
| 2,642,288 | 6/1953 | Bell | 482/96 |
| 2,682,401 | 6/1954 | Curtis | 482/96 |
| 2,880,010 | 3/1959 | Levinson | 280/226.1 X |
| 2,924,456 | 2/1960 | Miller | 482/96 |
| 2,986,405 | 5/1961 | Spratt | 280/1.191 X |
| 3,446,503 | 5/1969 | Lawton . | |
| 3,892,404 | 7/1975 | Martucci . | |
| 4,043,552 | 8/1977 | Kerkonian | 482/96 |
| 4,191,370 | 3/1980 | Meyer et al. | 482/96 |
| 4,197,839 | 4/1980 | Lay . | |
| 4,300,760 | 11/1981 | Bobroff | 482/96 |
| 4,341,378 | 7/1982 | Agyagos . | |
| 4,372,551 | 8/1983 | Yurdin . | |
| 4,419,989 | 12/1983 | Herbold . | |
| 4,468,025 | 8/1984 | Sferle . | |
| 4,508,358 | 4/1985 | Erel | 280/230 X |
| 4,566,691 | 1/1986 | Mahnke . | |
| 4,627,619 | 12/1986 | Rockwell et al. . | |
| 4,632,390 | 12/1986 | Richey | 482/96 |
| 4,700,946 | 10/1987 | Breunig . | |
| 4,743,010 | 5/1988 | Geraci | 482/95 X |
| 4,949,958 | 8/1990 | Richey | 482/96 |
| 5,178,599 | 1/1993 | Scott | 482/96 X |

*Primary Examiner*—Robert Bahr

*Attorney, Agent, or Firm*—Michael R. Swartz

[57] ABSTRACT

An aerobic exercise chair includes a main frame and a seat assembly pivotally connected to a rear end portion of the main frame for angular movement relative thereto. A handle assembly is pivotally connected to a front end portion of the main frame and by a connecting link to the front end of a yoke assembly that is mounted to and projects forwardly from a lower support frame of the seat assembly. A user desiring to achieve an aerobic workout sits on the seat assembly, grasps the free end of the handle assembly, and pulls it towards himself resulting in the connecting link forcing the free end of the yoke assembly to move downwardly thereby causing the seat assembly with the user resting thereon to pivot upwardly towards the free end of the handle assembly whereby the user is raised against his own weight relative to the main frame.

12 Claims, 6 Drawing Sheets

Fig. 4
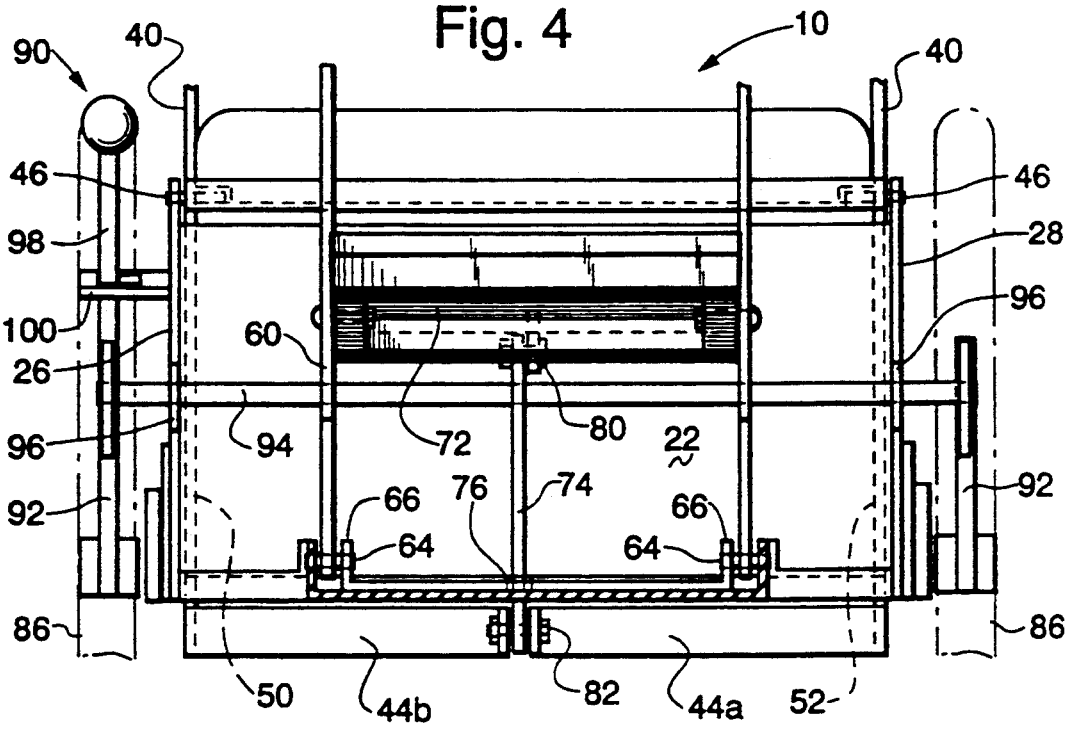
Fig. 5
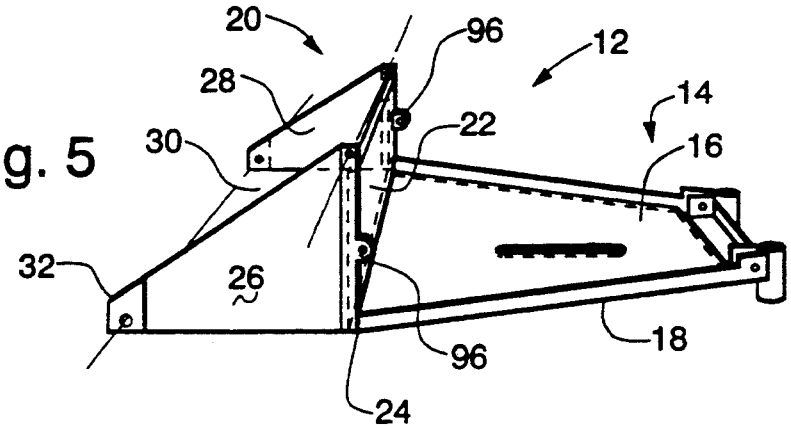
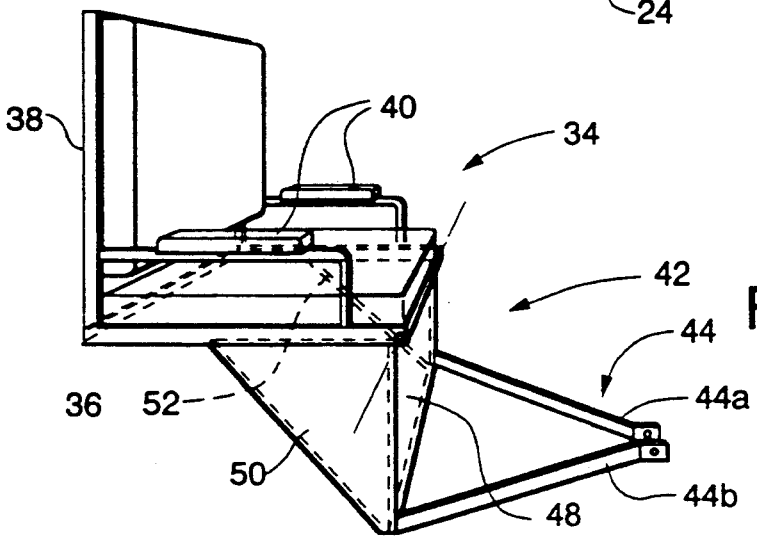
Fig. 6

AEROBIC EXERCISE CHAIR

BACKGROUND OF THE INVENTION

1. Field of the Invention

The present invention relates generally to exercise devices and, more particularly, to an exercise device designed to allow particularly older users or users having reduced physical capacity to simply and efficiently perform an aerobic exercise routine by raising his or her own weight while sitting in a chair.

2. Description of the Prior Art

Many known exercise devices allow a person to work against the resistance of his or her own weight. For example, the exercise device disclosed in U.S. Pat. No. 3,892,404 is one such device which comprises a carriage mounted on wheels that travels along track members. At one end, a pair of support posts maintains the track members at a desired inclination. The user may then sit on the carriage, lock his feet in a pair of foot rests, and propel himself and the carriage along the inclined track members by means of his leg muscles. While this exercise device allows a person to work against his or her own weight, it has several undesirable characteristics. For example, the carriage is positioned at the same inclination as the track members. Consequently, when the track members are positioned at an inclination steep enough to provide an effective workout, the user may experience considerable difficulty and discomfort in sitting on the steeply inclined carriage. This problem is particularly burdensome for those with reduced physical capacity using the exercise device for rehabilitation or older users using the device to achieve aerobic fitness.

Another exercise device which enables a person to exercise against the resistance of his or her own weight is disclosed in U.S. Pat. No. 4,700,946. This exercise device includes a base, a track mechanism pivotally mounted to the base and a structure for supporting the user. The user support structure is mounted to the track mechanism for linear displacement along the track mechanism at a generally constant orientation with respect to the base. The exercise device also comprises an arrangement interconnected between the track mechanism and the base for varying the angle between the track mechanism and the base without varying the orientation of the support structure with respect to the base. Finally, the exercise device includes a post assembly attached to the base. The post assembly includes a post for mounting at least one exercise apparatus such as a restorer, i.e., a set of pedals, and a mechanism for adjusting the distance between the mounting post and the track mechanism. With this device, the user exercises by repeatedly pushing himself and the user support structure up the track members by means of a stationary bar secured to the post assembly. While this exercise device also allows the user to work against the resistance of his or her own weight, it also has its problems. For example, since the user is required to push against a stationary bar in order to raise himself and the user support structure, there appears to be a tendency for the user to lean forward in the support structure or bend his back while exerting pressure against the stationary bar. Obviously, this could result in back strain or injury, particularly to the older user.

As described, each of the cited exercise devices, although operable to provide a user with an aerobic workout as the user exercises against the resistance of his or her own weight, can cause the user problems, particularly if the user is older or of reduced physical capacity.

Consequently, a need exists for an exercise device especially designed for older users or users of reduced physical capacity which is constructed to provide the user with a safe and effective aerobic workout as the user exercises against the resistance of his or her own weight.

SUMMARY OF THE INVENTION

The present invention relates to an aerobic exercise chair designed to satisfy the aforementioned needs. The aerobic exercise chair of the present invention provides the user with a satisfying upper and lower body workout while simultaneously eliminating the problems associated with similar devices presently known and used.

Accordingly, the present invention is directed to an aerobic exercise chair which allows a user to exercise by raising and lowering his or her own weight. The exercise chair comprises: (a) a main frame having a front end portion with upper and lower surfaces and a generally U-shaped rear end portion integral with the front end portion and arranged to extend rearwardly from the front end portion to define a channel-like opening in the rear end portion; (b) a seat assembly including a seat and a support frame positioned within the channel-like opening and a yoke assembly integral with and extending from the seat assembly so as to be positioned beneath the lower surface of the front end portion of the main frame; (c) a pivot arrangement for connecting the seat assembly to the main frame and permitting angular displacement of the seat assembly relative to the main frame; (d) a handle assembly having a lower end portion pivotally connected to the front end portion of the main frame and an opposite, free end portion located above the upper surface of the front end portion; and (e) a connecting link pivotally interconnecting the lower end portion of the handle assembly to a free end of the yoke assembly. Upon movement of the free end portion of the handle assembly from a rest position towards the seat assembly by a user sitting on the seat, the connecting link forces the free end of the yoke assembly to move in a downward direction simultaneously causing the seat and the user to be raised in an upward direction toward the upper end portion of the handle assembly as the seat assembly pivots in an upward direction about the pivot arrangement.

The aerobic exercise chair also includes a pair of front caster wheels and rear spaced wheels suitably attached to the respective front and rear end portions of the main frame for mobility of the chair as well as a braking mechanism to prevent undesired movement of the chair.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 4 is an enlarged front elevational view of the aerobic exercise chair taken along section line 4—4 of FIG. 2, illustrating in more detail the connection of the handle assembly to the main frame and the components of the brake assembly;

FIG. 5 is a perspective view of the main frame which forms a portion of the aerobic exercise chair and being shown separately therefrom;

FIG. 6 is a perspective view of the seat assembly which forms another portion of the aerobic exercise chair and being shown separately therefrom;

DETAILED DESCRIPTION OF THE INVENTION

Figure 1:
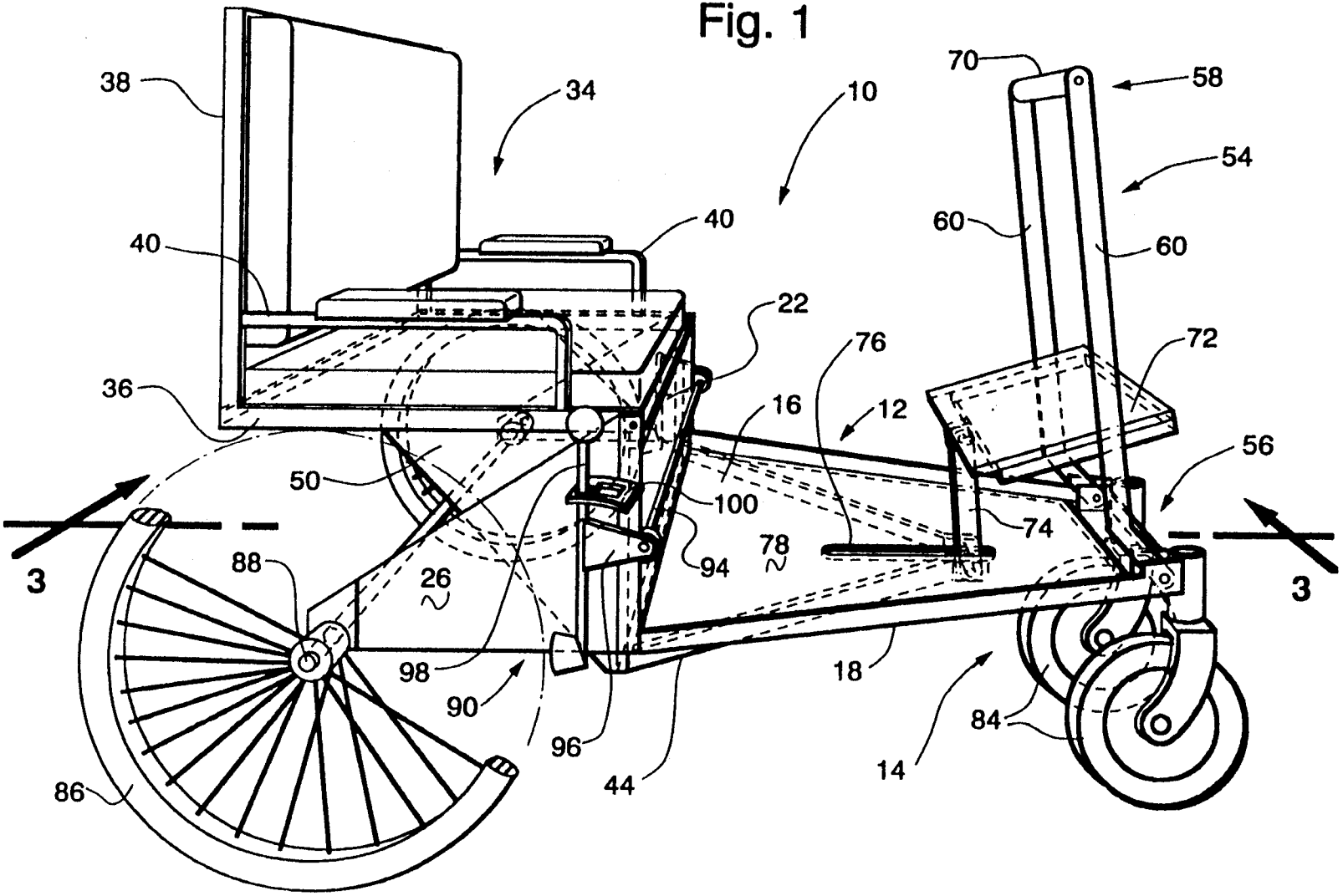
FIG. 1 is a perspective view of the aerobic exercise chair of the present invention, illustrating the main frame of the exercise chair supported by pairs of front and rear wheels, a seat assembly connected to the main frame so that it may be angularly displaced relative to the main frame and a handle assembly connected to the seat assembly via a connecting link.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1-6, there is illustrated an aerobic exercise chair, generally designated by the numeral 10, designed to permit a user, particularly an older user or a user with reduced physical capacity, to achieve aerobic fitness. The aerobic exercise chair 10 includes a main frame 12 having a front end portion 14 with upper and lower surfaces 16, 18, respectively. As best seen in FIG. 5, the main frame 12 further includes a generally U-shaped rear end portion 20 integral with the front end portion 14 and extending rearwardly from the front end portion 14. The generally U-shaped rear end portion 20 includes an upstanding front wall 22 positioned adjacent to the rear end 24 of the front end portion 14. The generally U-shaped rear end portion 20 also includes a pair of spaced-apart side walls 26, 28, each being perpendicular with the upstanding front wall 22. The pair of spaced-apart side walls 26, 28 extend rearwardly from the upstanding front wall 22 to give the rear end portion 20 its generally U-shaped configuration. In addition, the pair of spaced-apart side walls 26, 28 are positioned relative to the upstanding front wall 22 to define a channel-like opening 30 in the rear end portion 20 of the main frame 12 which opens to the rear end 32 of the main frame 12.

Figure 2:
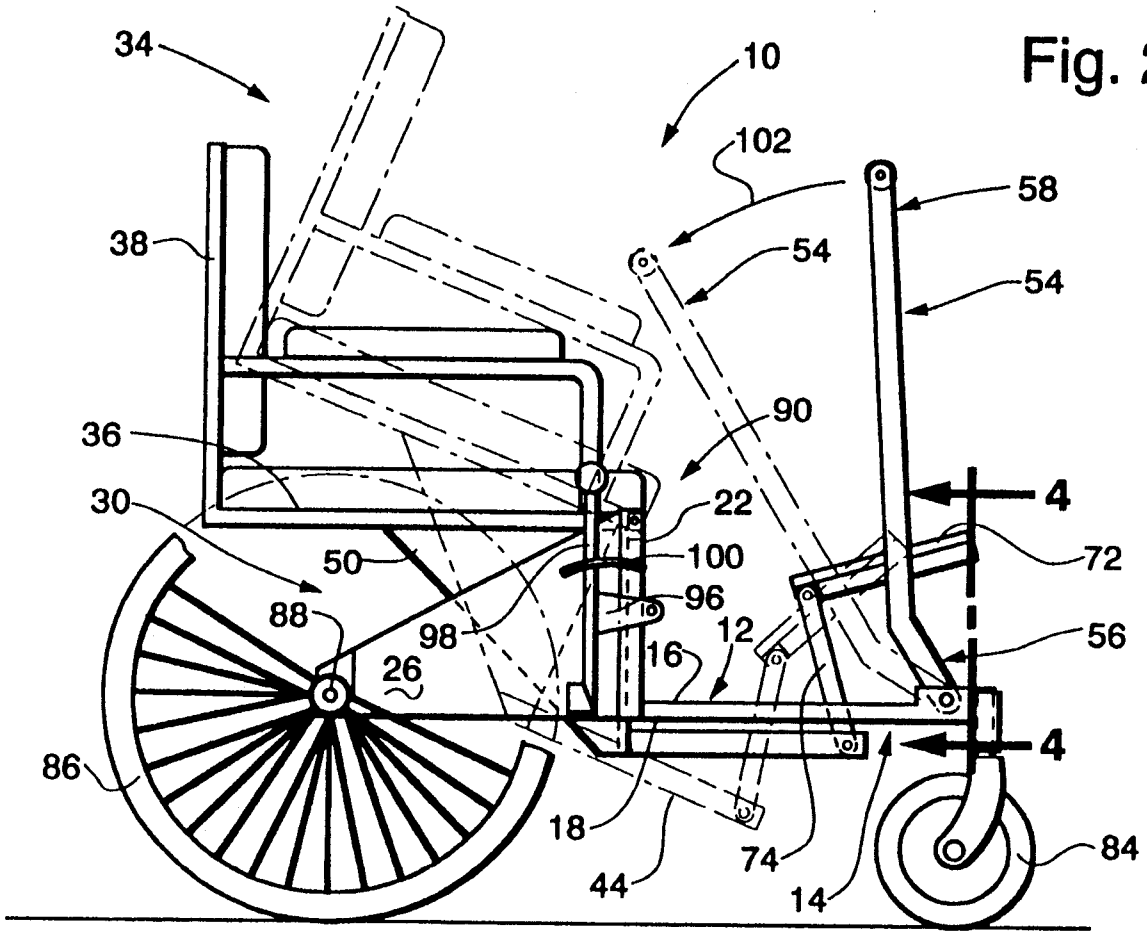
FIG. 2 is a side elevational view of the aerobic exercise chair of the present invention, illustrating in solid-line form the exercise chair in a rest position with the seat assembly positioned to allow a user to mount the exercise device and sit on a seat and with the handle assembly being in an upright position, and illustrating in dotted-line form the seat assembly and the handle assembly each being inclined toward one another and angularly displaced relative to the main frame as a user performs aerobic exercise.

As seen in FIG. 1 and more clearly shown in FIG. 6, the aerobic exercise chair 10 further includes a seat assembly 34 having a construction which allows it to fit within the channel-like opening 30 in the U-shaped rear end portion 20 of the main frame 12. The seat assembly 34 includes a generally horizontal seat 36, an upright backrest 38 attached to the rear end of the seat 36 and a pair of spaced arm rails 40 that are generally parallel to the seat 36. The seat assembly 34 further includes a lower support frame 42 positioned beneath and secured to the seat 36 and a yoke assembly 44 rigidly attached to the lower end of the support frame 42 and extending forwardly therefrom for positioning beneath the lower surface 18 of the front end portion 14 of the main frame 12 in an assembled mode as seen in FIGS. 1 and 2. The yoke assembly 44 is of a generally V-shaped configuration being formed of two members **44*a*, 44*b* that are mounted at one end to the support frame 42 and project forwardly therefrom in a converging manner such that the distance between the forward free opposite ends of members 44*a*, 44*b* is substantially less than the distance between the mounted ends of the members. In the assembled mode, the seat assembly 34 is pinned to the main frame 12 by a pair of pivot pin fasteners 46 that extend through appropriate holes on opposite sides of the lower support frame 42 and corresponding holes in the opposite side walls 26, 28 of the main frame 12 (best seen in FIG. 4) so as to allow angular displacement of the seat assembly 34 relative to the main frame 12. The lower support frame 42 is comprised of a front wall 48 rigidly attached to and projecting downwardly from the front edge of the seat 36 and a pair of opposite side gussets 50, 52 rigidly interconnecting the side edges of the front wall 48 to the opposite side edges of the seat 36. The lower support frame 42 is of a dimension such that when the seat assembly 34 is in its rest position, the lower support frame 42 is received within the channel-like opening 30 of the rear end portion 20 of the main frame 12. It should also be understood that the seat assembly 34, being comprised of the horizontal seat 36, backrest 38, arm rails 40, the lower support frame 42 that includes the front wall 48 and side gussets 50, 52, and the yoke assembly 44, is an integral rigid structure that is adapted to pivot about fasteners 46 for angular displacement of the seat assembly 34 relative to the main frame 12**.

Figure 3:
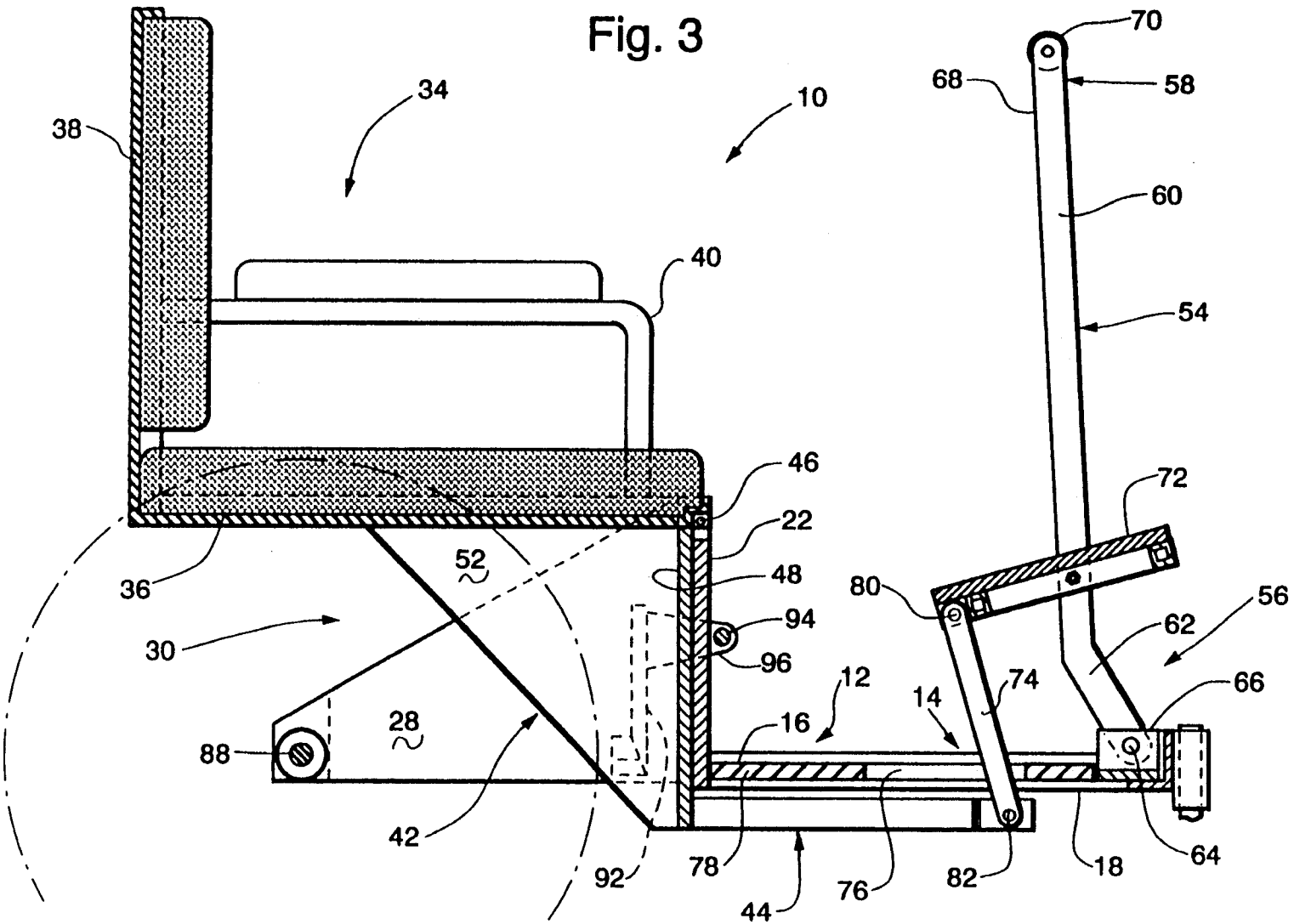
FIG. 3 is an enlarged sectional view of the aerobic exercise chair taken along line 3—3 of FIG. 1, illustrating the position of the seat assembly relative to the main frame with the exercise chair in a rest position.

The aerobic exercise chair 10 further includes a handle assembly 54 positioned at the front end of the front end portion 14 of the main frame 12. The handle assembly 54 has a lower end portion 56 pivotally connected with the main frame 12 and an opposite, free end portion 58 extending above the upper surface 16 of the main frame front end portion 14. In particular, the handle assembly 54 is formed from a pair of spaced apart, preferably tubular or bar-like members 60, each of which having its lower end 62 connected for pivotal movement to the main frame 12 via a pivot pin 64 that extends through a clevis bracket 66 mounted on the front end portion 14 of main frame 12, as best seen in FIGS. 3 and 4. The opposite free end 68 of members 60 are joined by a cross-member 70 which operates to move the pair of members 60 in unison as the handle assembly 54 is pivotally moved by a user of the exercise chair 10. Located along the lower end portion 56 of handle assembly 54 is a cross-support foot plate 72 that extends between and is fixedly attached to the pair of members 60 for supporting a user's feet and lower legs during operation of the aerobic exercise chair 10.

The handle assembly 54 is connected to the forward end of yoke assembly 44 of the seat assembly 34 via a connecting link 74 which extends through a slotted opening 76 in the floor 78 of the front end portion 14 of main frame 12. The link 74 has one end pivotally connected to the cross-support plate 72 by pivot pin 80 and its opposite end pivotally connected to the front end of yoke assembly 44 by a pivot pin 82. As will be explained later in greater detail, the connecting link 74 is operable upon movement of the free end portion 58 of the handle assembly 54 from a rest position, shown in solid-line form in FIG. 2, towards the seat assembly 34 by a user sitting on the seat 36 to cause an angular displacement of the seat assembly 34 relative to the main frame 12 by forcing the yoke assembly 44 to pivot in a downward direction about the pair of pivot pins 46 and simultaneously lifting the seat assembly 34 and a user sitting in the seat 36 as the seat assembly 34 pivots in an upward direction about the pivot pins 46 to an in-use position shown in dotted-line form in FIG. 2.

For mobility, the aerobic exercise chair 10 further includes a pair of front caster wheels 84 connected to the front of the main frame front end portion 14 and a pair of spaced rear wheels 86 mounted on an axle 88 that extends between the sidewalls 26, 28 of main frame 12 and located below the seat assembly 34. A conventional brake assembly 90 is also provided for preventing undesired movement of the exercise chair 10 when in use or in storage. As best seen in FIGS. 3 and 4, the brake assembly 90 includes a pair of brake arms 92, with one arm 92 being positioned adjacent to each rear wheel 86 and connected together for unison movement by a tie rod 94. The tie rod 94 is rotatable in a pair of eyelets 96 secured to the upstanding front wall 22 of the main frame 12 for moving the brake arms 92 in unison into and out of contact with the rear wheels 86 upon movement of a brake handle 98 that is connected to one end of the tie rod 94. The brake handle 98 is pivotally connected at its lower end to the side of the main frame 12 and extends up through a slotted locking bracket 100 also attached to the same side of the main frame 12. Upon movement of the brake handle 98 to a forward locking position within the locking bracket 100, the brake arms 92 are maintained in contact with the rear wheels 86 so as to prevent forward or reverse movement of chair 10.

To achieve an aerobic workout, a user sitting on the seat assembly 34 grasps the free end 58 of the handle assembly 54 and pulls it towards himself, in a direction indicated by the arrow 102 of FIG. 2, which causes the handle assembly 54 and the fixed cross-support foot plate 72 therewith to rotate about the pair of pivot pins 64 in a counterclockwise direction as viewed in FIG. 2. Such counter-clockwise rotation of handle assembly 54 forces the connecting link 74 to move in a rearwardly and downwardly direction about pivot pin 80 which thereby causes the connecting link 74 to rotate in a clockwise direction about pivot pin 82 which connects the connecting link 74 to the forward end of yoke assembly 44. Downward movement of link 74 causes the front end of yoke assembly 44 to move further downwardly below the floor 78 of the front end portion 14 of main frame 12. Since the yoke assembly 44 is an integral component of the seat assembly 34 and with the seat assembly 34 being pivotally connected at 46 to the main frame 12, downward movement of the forward end of the yoke assembly 44 causes the seat assembly 34 to pivot upwardly in a clockwise direction about the pinning locations 46 from its solid-line position to its dotted-line position as seen in FIG. 2.

In the rest position, the seat assembly 34 can only rotate about pivot pins 46 in a clockwise direction relative to the main frame 12 and cannot rotate in a counter-clockwise direction due to the unique construction of the chair 10 when in its assembled mode. In the assembled mode with the seat assembly 34 positioned within the channel-like opening 30 of the main frame rear end portion 20 and being pivotally connected to the main frame 12 at pivot locations 46 and with the yoke assembly 44 being pivotally connected to the connecting link 74, the downwardly facing front wall 48 of the lower support frame 42 of seat assembly 34 abuts the back side of the upstanding front wall 22 of the main frame 12 in performing a "stop" so as to prevent the seat assembly 34 to pivot in a counter-clockwise direction relative to the main frame about pivot pins 46. Since the seat assembly 34 can only move in a clockwise direction (from its rest position) due to the abutment of the seat assembly lower support frame front wall 48 with the main frame front wall 22 and since the connecting link 74 can only move upon movement of the yoke assembly 44, then movement of the handle assembly 54 in a counter-clockwise direction forces the connecting link 74 to pivot in a clockwise direction about pivot pin 82 in thereby forcing the front end of yoke assembly 44 to move downwardly and rearwardly, causing the seat assembly 34 to pivot in a clockwise direction about pivot pins 46 and thus pivotal raising of the seat assembly 34 toward the handle assembly 54. Without a thorough appreciation of the relative movement of the components of chair 10, it would appear at first glance that a counter-clockwise movement of handle assembly 54 toward a user setting on the seat assembly 34 would cause the connecting link 74 to pivot in the same counter-clockwise direction, however, as explained in detail above, this cannot happen due to the abutment engagement of seat frame wall 48 and main frame front wall 22 which only enables the seat assembly 34 to pivot forwardly in a clockwise direction as the handle assembly is pivotally rearwardly in a counter-clockwise direction. As can be appreciated, when the handle assembly 54 is pivoted from its dotted-line use position counter-clockwise to its solid-line rest position, as seen in FIG. 2, the seat assembly 34 pivots in a reverse counter-clockwise direction from its dotted-line raised position to its solid-line rest position.

Figure 7:
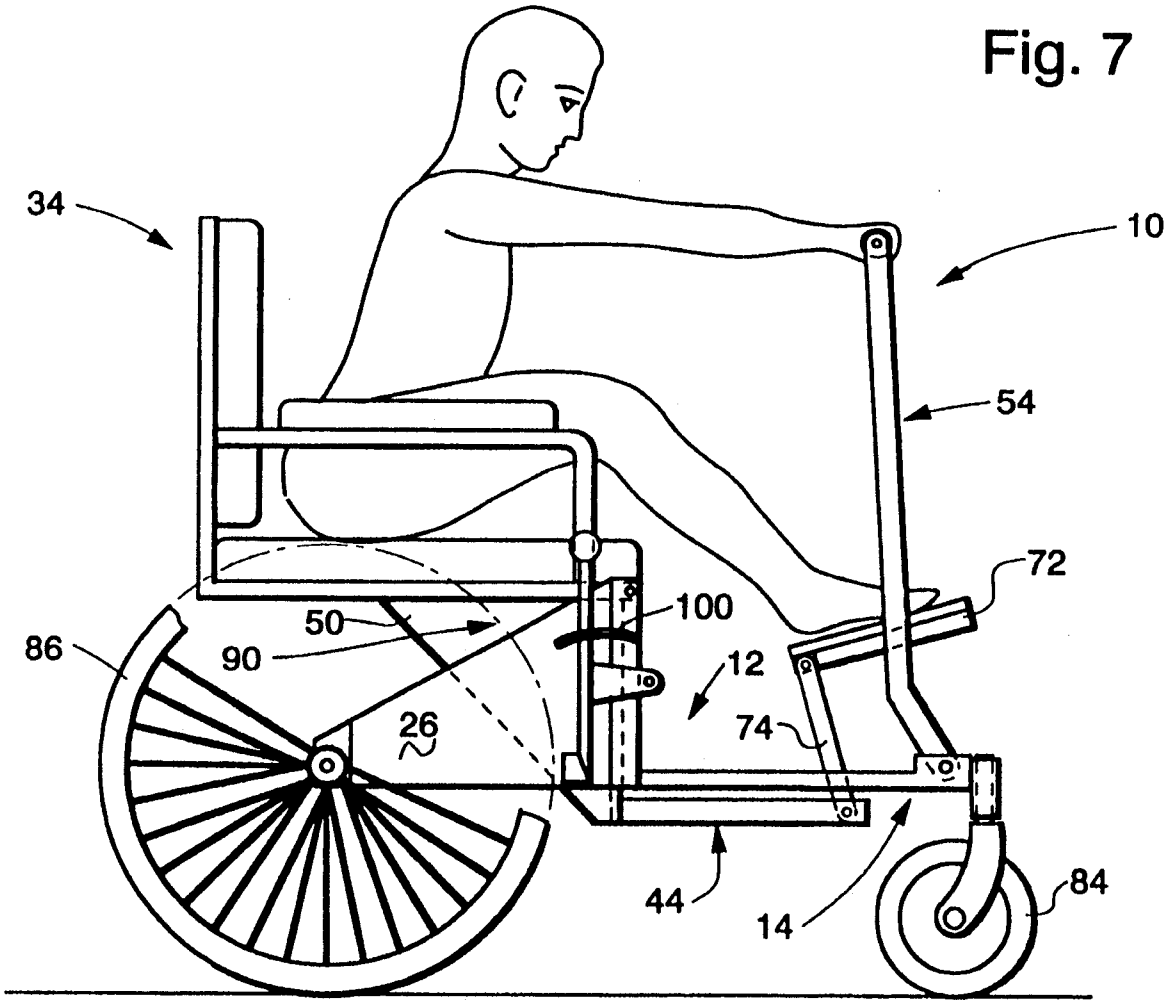
FIG. 7 is a side elevational view of the aerobic exercise chair of the present invention, illustrating a user sitting on the seat and grasping the handle assembly prior to commencing an aerobic workout.
Figure 8:
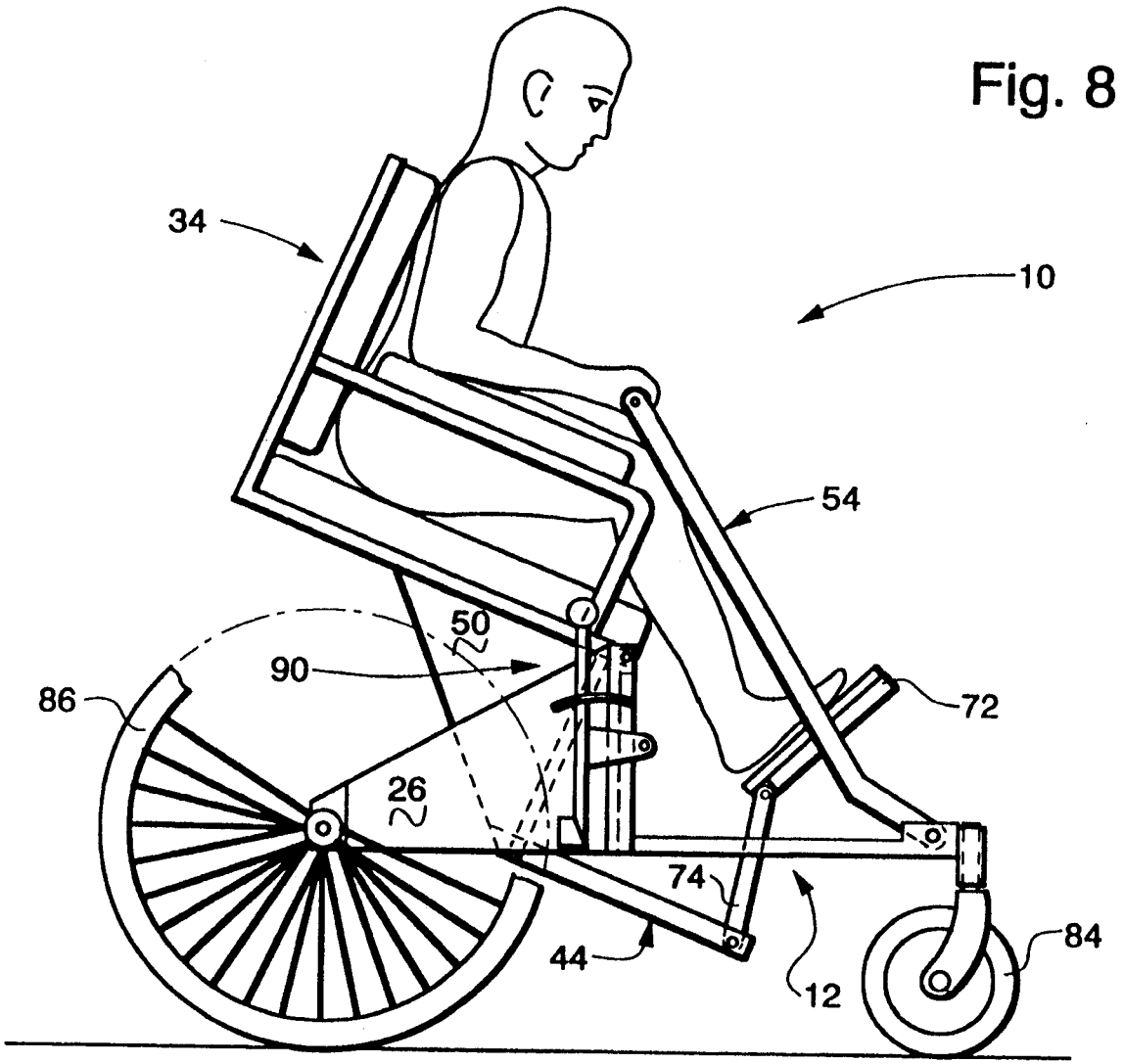
FIG. 8 is a side elevational view of the aerobic exercise chair of the present invention, illustrating the seat assembly and handle assembly angularly displaced from the main frame and being inclined toward one another as the user pulls the handle assembly towards himself to lift his weight during an aerobic workout.

As understood from the above description, a user of the exercise chair 10 can achieve an aerobic workout by raising his or her own weight. In operation, as seen in FIGS. 7 and 8, a user positions himself, as illustrated in FIG. 7, so that his upper back and shoulders rests against the backrest 38, his buttocks resting on seat 36 and his feet are supported on the foot plate 72. The user then grasps the free end 58 of handle assembly 54 with both hands and pulls it towards himself, forcing the seat assembly 34 with his weight upon it to pivot forwardly toward the approaching handle assembly 54 as shown in FIG. 8. During such motion, the user can either exert pressure on the foot plate 72 through his feet to increase the difficulty in moving the handle assembly 54 toward him, or, in the same token, exert pressure through his feet to assist in moving the handle assembly toward himself. Once the user reaches the position shown in FIG. 8, he then pushes the handle assembly 54 in the reverse direction to its original rest position of FIG. 7. As can be appreciated, the user physically controls the rate of movement of the handle assembly 54 toward and away from himself to achieve the degree of exercise desired.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the form hereinbefore described being merely a preferred or exemplary embodiment thereof.

I claim:

1. An aerobic exercise chair which allows a user to exercise by raising and lowering his or her own weight, comprising:

(a) a main frame having a front end portion with upper and lower surfaces and a generally U-shaped rear end portion integral with said front end portion and extending rearwardly therefrom in defining a channel-like opening in said rear end portion;

(b) a seat assembly having a seat and a yoke assembly integral with and projecting forwardly from said seat, said seat assembly being positioned relative to said main frame such that said seat is disposed within said channel-like opening and said yoke assembly is disposed beneath said lower surface of said front end portion of said main frame when said seat assembly is in a rest position;

(c) pivot means connecting said seat assembly to said main frame for permitting angular displacement of said seat assembly relative to said main frame;

(d) a handle assembly having a lower end portion pivotally connected to said front end portion of said main frame and an opposite, upper free end portion for grasping by an operator; and (e) a connecting link pivotally interconnecting a lower portion of said handle assembly to a free end of said yoke assembly, said link being operable upon movement of said free end portion of said handle assembly from a rest position towards said seat assembly by a user sitting on said seat to cause an angular displacement of said seat assembly relative to said main frame by forcing said free end of said yoke assembly to pivot in a downward direction about said pivot means and simultaneously causing said seat assembly and said user to be raised as said seat assembly pivots in an upward direction about said pivot means.

2. The aerobic exercise chair as recited in claim 1, wherein said generally U-shaped rear end portion of said main frame is formed from an upstanding front wall and a pair of spaced-apart side walls mounted to and extending rearwardly from said front wall to thereby define said channel-like opening.

3. The aerobic exercise chair as recited in claim 2, wherein:

said seat assembly further includes a lower support frame for supporting said seat and formed from a downwardly extending front wall and a pair of spaced-apart side walls mounted to said front wall and extending rearwardly therefrom; and said lower support frame being dimensioned so as to be received within said channel-like opening of said rear end portion of said main frame when said seat assembly is located at said rest position.

4. The aerobic exercise chair as recited in claim 3, wherein said rest position of said seat assembly said downwardly extending front wall of said lower support frame abuts said upstanding front wall of said main frame causing said connecting link to force said free end of said yoke assembly to move downwardly away from said lower surface of said front end portion of said main frame as said free end portion of said handle assembly is moved from said rest position towards said seat by said user whereby said downward movement of said connecting link causes said seat assembly and user thereon to rotate about said pivot means in an upward direction toward said upper end portion of said handle assembly.

5. The aerobic exercise chair as recited in claim 3, wherein said yoke assembly has a generally V-shaped configuration and is formed from a pair of members mounted at one end to said front wall of said lower support frame and projecting forwardly therefrom in a converging fashion such that the distance between the opposite free ends of said members is substantially less than the distance between said mounted ends of said members.

6. The aerobic exercise chair as recited in claim 1, wherein said handle assembly includes:

a pair of spaced-apart members each having one end connected to said front end portion of said main frame for pivotal movement relative thereto and an opposite, free end;

a cross-bar interconnecting said free ends of said spaced-apart members for grasping by a user whereby said members can be pivoted in unison relative to said main frame; and a support plate for supporting a user's feet that extends between and is attached to said spaced-apart members at a location between said opposite ends of said members.

7. The aerobic exercise chair as recited in claim 6, wherein one end of said connecting link is pivotally connected to said support plate and the opposite other end of said connecting link is pivotally connected to said free end of said yoke assembly.

8. The aerobic exercise chair as recited in claim 1, further comprising a pair of spaced front caster wheels attached to said front end portion of said main frame and a pair of spaced-apart rear wheels attached to said rear end portion of said main frame to facilitate movement of said chair over a surface.

9. The aerobic exercise chair as recited in claim 8, further comprising a brake assembly attached to said rear end portion of said main frame and including a pair of brake arms with each arm being operable to engage one of said rear wheels so as to prevent undesired movement of said exercise chair.

10. The aerobic exercise chair as recited in claim 9, wherein said brake assembly further includes locking means for maintaining said pair of brake arms in engagement with said pair of rear wheels.

11. The aerobic exercise chair as recited in claim 1, wherein said front end portion of said main frame includes a floor portion having a generally planar configuration.

12. The aerobic exercise chair as recited in claim 11, wherein said floor portion has a slotted opening defined therein for receiving therethrough said connecting link that interconnects said handle assembly to said yoke assembly.

* * * * *